United States Patent [19]

Otobe

[11] Patent Number: 4,502,448

[45] Date of Patent: Mar. 5, 1985

[54] METHOD FOR CONTROLLING CONTROL SYSTEMS FOR INTERNAL COMBUSTION ENGINES IMMEDIATELY AFTER TERMINATION OF FUEL CUT

[75] Inventor: Yutaka Otobe, Shiki, Japan

[73] Assignee: Honda Motor Co., Ltd., Tokyo, Japan

[21] Appl. No.: 500,780

[22] Filed: Jun. 3, 1983

[30] Foreign Application Priority Data

Jun. 18, 1982 [JP] Japan ..... 57-104802

[51] Int. Cl.[3] ..... F02M 51/00

[52] U.S. Cl. ..... 123/480; 123/492; 123/493; 123/494

[58] Field of Search ..... 123/480, 478, 493, 492, 123/494; 73/115

[56] References Cited

U.S. PATENT DOCUMENTS

| | | | |
|---|---|---|---|
| 4,010,717 | 3/1977 | Taplin . | |
| 4,184,458 | 1/1980 | Aoki et al. | 123/480 |
| 4,242,991 | 1/1981 | Scherenberg et al. . | |
| 4,245,605 | 1/1981 | Rice et al. | 123/480 |
| 4,367,713 | 1/1983 | Otsuka et al. | 123/494 |
| 4,377,145 | 3/1983 | Nagaishi | 123/480 |
| 4,411,232 | 10/1983 | Atago et al. | 123/494 |
| 4,430,976 | 2/1984 | Kondo et al. | 123/480 |

*Primary Examiner*—Parshotam S. Lall

*Attorney, Agent, or Firm*—Arthur L. Lessler

[57] ABSTRACT

A method for controlling a control system which controls an internal combustion engine, in response to at least one control parameter including intake pipe pressure, immediately after termination of a fuel cut operation. When a transition is detected from an operating condition of the engine requiring interruption of fuel supply to the engine to an operating condition of the engine requiring fuel supply to the engine, a value of the intake pipe pressure detected by pressure sensor means is changed by a predetermined amount, from a time immediately after the above transition has been detected to a time the engine finishes a predetermined number of strokes after the transition, and the value of the intake pipe pressure thus changed is applied for controlling the above engine control system. Preferably, the predetermined amount by which a detected value of the intake passage absolute pressure is reduced is set to a value corresponding to a difference between a value of intake passage pressure occurring at non-combustion operation of the engine and a value of intake passage pressure occurring at normal combustion operation of the engine, so far as the rotational speed of the engine is the same between the above two operations of the engine. The above engine control system includes a fuel injection system which controls the quantity of fuel being supplied to the engine at least in response to the intake pipe pressure.

11 Claims, 6 Drawing Figures

METHOD FOR CONTROLLING CONTROL SYSTEMS FOR INTERNAL COMBUSTION ENGINES IMMEDIATELY AFTER TERMINATION OF FUEL CUT

BACKGROUND OF THE INVENTION

This invention relates to a control method for controlling control systems for internal combustion engines, and more particularly to a control method of this kind, which is adapted to nominally change intake pipe pressure used as a control parameter for controlling an engine control system, immediately after termination of a fuel cut operation, so as to obtain an amount of control of the engine control system appropriate for the actual operating condition of the engine, thereby improving the emission characteristics, fuel consumption, etc. of the engine.

It is already known, e.g. by Japanese Patent Provisional Publication (KOKAI) No. 57-191426, to interrupt the supply of fuel to an internal combustion engine when the engine is operating in a particular operating region such as a decelerating region, so as to improve the emission characteristics and fuel consumption of the engine, as well as to prevent overheating of exhaust gas purifying means such as a three-way catalyst arranged in the exhaust pipe of the engine.

It is also generally known that an actual quantity of intake air supplied to an internal combustion engine is larger during normal combustion operation of the engine than during non-combustion operation (hereinafter merely called "motoring") of same, namely, the charging efficiency of the engine is higher during normal combustion operation than during motoring. This means that so long as the intake air quantity remains the same, the intake pipe absolute pressure is higher during motoring of the engine than during normal combustion operation of same. In determining various control parameters for controlling the operation of an internal combustion engine, for example, fuel supply quantity, ignition timing, exhaust gas recirculation amount, and quantity of supplementary air for control of idling speed, by the use of intake pipe absolute pressure, such control parameters are usually determined as a function of intake pipe absolute pressure.

However, the intake pipe absolute pressure occurring immediately after termination of a fuel cut operation shows a higher value than during normal combustion operation of the engine. If this higher intake pipe absolute pressure is directly applied as a control parameter signal, for example, to control the fuel supply quantity, an excessive quantity of fuel can be supplied to the engine, badly affecting the emission characteristics, fuel consumption, etc. of the engine.

SUMMARY OF THE INVENTION

It is the object of the invention to provide a control method for controlling a control system which controls the operation of an internal combustion engine, which method is adapted to nominally change a detected value of intake pipe pressure as a control parameter, by a predetermined amount, immediately after termination of a fuel cut operation, so as to obtain an amount of control of the control system appropriate for the actual operating condition of the engine on such occasion, to thereby improve the emission characteristics and fuel consumption of the engine as well as the driveability of same.

The present invention provides a method for controlling a control system for an internal combustion engine, in response to at least one control parameter including values of intake passage pressure detected by pressure sensor means arranged in an intake passage of the engine. The method according to the invention is characterized by comprising the following steps: (1) detecting whether or not there occurs a transition in the operating condition of the engine from an operating condition requiring interruption of fuel supply to the engine to an operating condition requiring fuel supply to the engine; (2) changing a value of the intake passage pressure detected by the pressure sensor means, by a predetermined amount, from a time immediately after the transition has been detected to a time the engine finishes a predetermined number of strokes; and (3) applying a value of the intake passage pressure thus changed, for controlling the control system.

The above pressure sensor means may include an absolute pressure sensor adapted to detect absolute pressure in the intake passsage, and wherein the above step (2) comprises reducing a value of intake passage absolute pressure detected by this absolute pressure sensor, by a predetermined amount.

Preferably, the above predetermined number of strokes of the engine is set to either one of the following: (1) a number of strokes of the engine required for the intake passage absolute pressure to drop from a level at the above transition to a level at normal combustion operation of the engine, after the transition; and (2) a number of strokes of the engine required for the intake passage absolute pressure to start dropping from a level at the above transition toward a level at normal combustion operation of the engine, after the transition.

Also, preferably, the aforementioned predetermined amount by which a detected value of the intake passage absolute pressure is reduced in the aforementioned step (2) is set to a value corresponding to a difference between a value of intake passage absolute pressure occurring at non-combustion operation of the engine and a value of intake passage absolute pressure occurring at normal combustion operation of the engine, so far as the rotational speed of the engine is the same between the two operations of the engine. The higher the engine rotational speed, the larger value the above predetermined amount for reduction of the detected intake passage absolute pressure is set to.

According to another aspect of the invention, the aforementioned step (2) comprises reducing a value of the intake passage absolute pressure detected by the absolute pressure sensor means, by a predetermined amount, from a time immediately after the transition has been detected to a time all the cylinders of the engine have been supplied with fuel after the transition.

Engine control systems to which is applicable the method of the invention may include a fuel injection system which is adapted to control the quantity of fuel being supplied to the engine, at least in response to intake passage absolute pressure. Preferably, the fuel injection system is adapted to inject fuel into the engine cylinders successively in synchronism with generation of pulses of a signal indicative of a predetermined crank angle of the engine, and the predetermined number of strokes is set to at least a number of strokes corresponding to a period of time required for the fuel injection system to effect a number of injections equal to the number of the cylinders of the engine after a transition to the operating condition requiring fuel supply to the engine.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
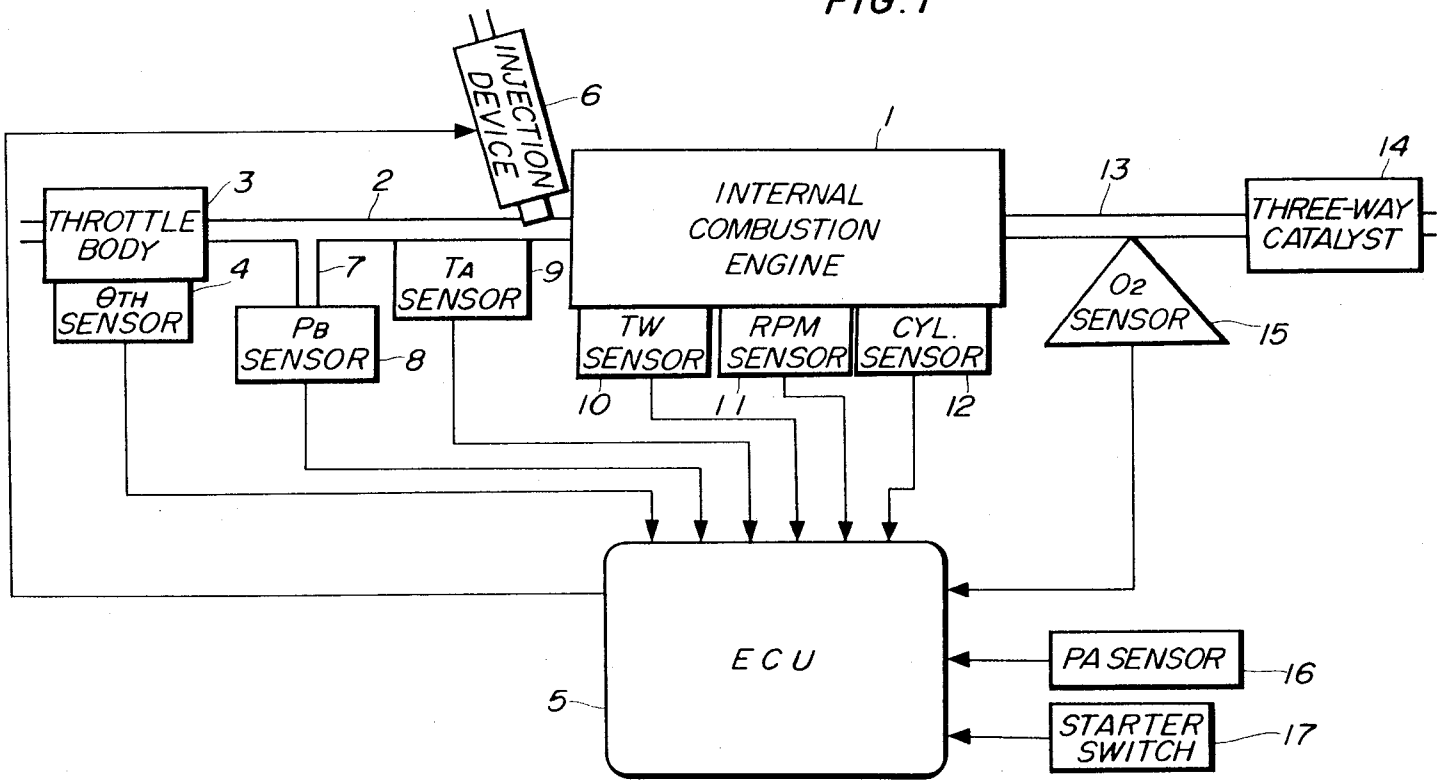
FIG. 1 is a block diagram illustrating an example of the whole arrangement of a fuel supply control system to which the method of the invention is applicable.

Referring first to FIG. 1, there is illustrated an example of the whole arrangement of a fuel supply control system for internal combustion engines, to which the present invention is applicable. Reference numeral 1 designates an internal combustion engine which may be a four-cylinder type, for instance, and to which is connected an intake passage 2 with a throttle valve 3 arranged therein. A throttle valve opening sensor 4 is mounted on the throttle valve 3 for detecting its valve opening and is electrically connected to an electronic control unit (hereinafter called "ECU") 5, to supply same with an electrical signal indicative of throttle valve opening detected thereby.

A fuel injection valve 6 is arranged in the intake passage 2 at a location slightly upstream of an intake valve of a corresponding one of the engine cylinders, not shown, and between the engine 1 and the throttle valve 3, for fuel supply to the corresponding engine cylinder. Each of such fuel injection valves 6 is connected to a fuel pump, not shown, and is electrically connected to the ECU 5, in a manner having their valve opening periods or fuel injection quantities controlled by signals supplied from the ECU 5.

On the other hand, an absolute pressure sensor 8 communicates through a conduit 7 with the interior of the intake passage 2 at a location immediately downstream of the throttle valve 3. The absolute pressure sensor 8 is adapted to detect absolute pressure in the intake passage 2 and applies an electrical signal indicative of detected absolute pressure to the ECU 5. An intake air temperature sensor 9 is arranged in the intake passage 2 at a location downstream of the absolute pressure sensor 8 and also electrically connected to the ECU 5 for supplying thereto an electrical signal indicative of detected intake air temperature.

An engine cooling water temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged on a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the starter of the engine 1, respectively, for supplying an electrical signal indicative of detected atmospheric pressure and an electrical signal indicative of its own on and off positions to the ECU 5.

The ECU 5 operates on the basis of the various engine parameter signals inputted thereto to determine engine operating conditions including the fuel cut effecting conditions as well as to calculate the valve opening period TOUT of the fuel injection valves 6 in response to the determined engine operating conditions by means of the following equation:

$$TOUT = Ti \times K_1 + K_2 \quad (1)$$

wherein Ti represents a basic value of the fuel injection period of the fuel injection valves 6 and is calculated as a function of the intake passage absolute pressure PBA and the engine rpm Ne, and $K_1$ and $K_2$ represent correction coefficients having their values dependent upon the values of signals from the aforementioned various sensors, that is, the throttle valve opening sensor 4, the intake passage absolute pressure sensor 8, the intake air temperature sensor 9, the engine cooling water temperature sensor 10, the Ne sensor 11, the cylinder-discriminating sensor 12, the $O_2$ sensor 15, the atmospheric pressure sensor 16, and the starter switch 17, and are calculated by the use of predetermined equations, so as to optimize the startability, emission characteristics, fuel consumption, accelerability, etc. of the engine.

The ECU 5 supplies driving signals to the fuel injection valves 6 to open same with a duty factor corresponding to the valve opening period TOUT calculated in the above manner.

Figure 2:
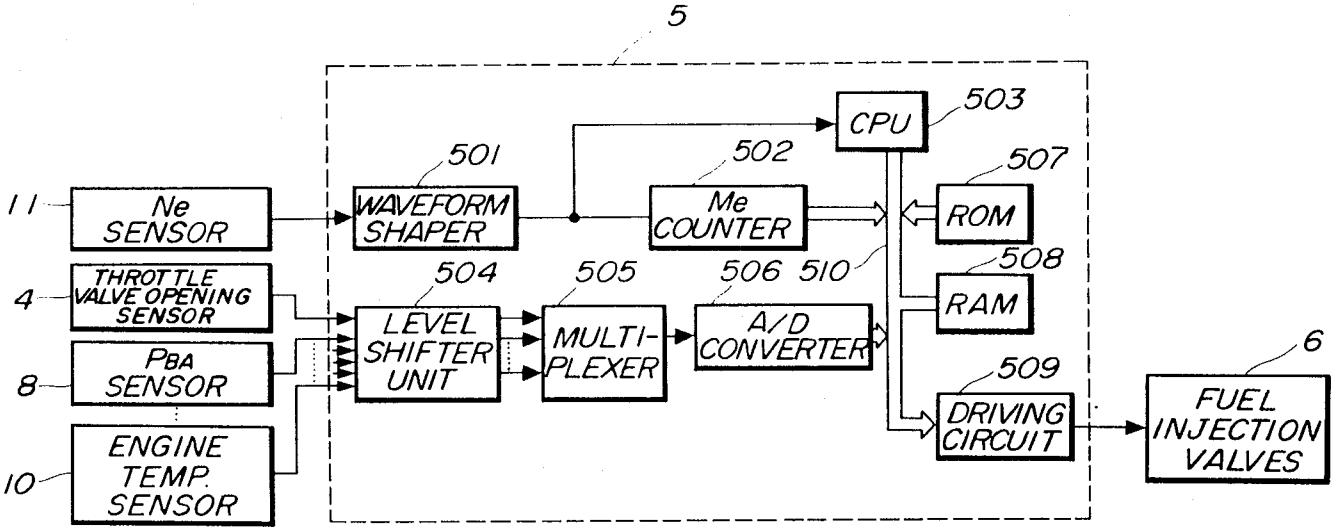
FIG. 2 is a circuit diagram showing an electrical circuit within an electronic control unit (ECU) appearing in FIG. 1.

FIG. 2 shows an electrical circuit within the ECU 5 in FIG. 1. The engine rpm signal from the Ne sensor 11 in FIG. 1 is applied to a waveform shaper 501, wherein it has its pulse waveform shaped, and supplied to a central processing unit (hereinafter called "CPU") 503 as a TDC signal as well as to a Me value counter 502. The Me value counter 502 counts the interval of time between a preceding pulse of the engine rpm signal generated at a predetermined crank angle of the engine and a present pulse of the same signal generated at the predetermined crank angle, inputted thereto from the Ne sensor 11, and therefore, its counted value Me corresponds to the reciprocal of the actual engine rpm Ne. The Me value counter 502 supplies the counted value Me to the CPU 503 via a data bus 510.

The respective output signals from the throttle valve opening sensor 4, the intake passage absolute pressure PBA sensor 8, the engine cooling water temperature sensor 10, all appearing in FIG. 1, and other sensors, if any, have their voltage levels shifted to a predetermined voltage level by a level shifter unit 504 and successively applied to an analog-to-digital converter 506 through a multiplexer 505. The A/D converter 506 successively converts the above signals into digital signals and supplies them to the CPU 503 via the data bus 510.

The CPU 503 is also connected to a read-only memory (hereinafter called "ROM") 507, a random access memory (hereinafter called "RAM") 508, and a driving circuit 509, through the data bus 510. The RAM 508 temporarily stores the resultant values of various calculations from the CPU 503, while the ROM 507 stores a control program executed within the CPU 503, a basic fuel injection period Ti map for the fuel injection valves 6, etc. The CPU 503 executes the control program stored in the ROM 507 to calculate the valve opening period TOUT for the fuel injection valves 6 in response to the various engine parameter signals referred to before, and supplies the calculated TOUT value to the driving circuit 509 via the data bus 510. The driving circuit 509 supplies driving signals corresponding to the above TOUT value to the fuel injection valves 6 to open same.

Figure 3:
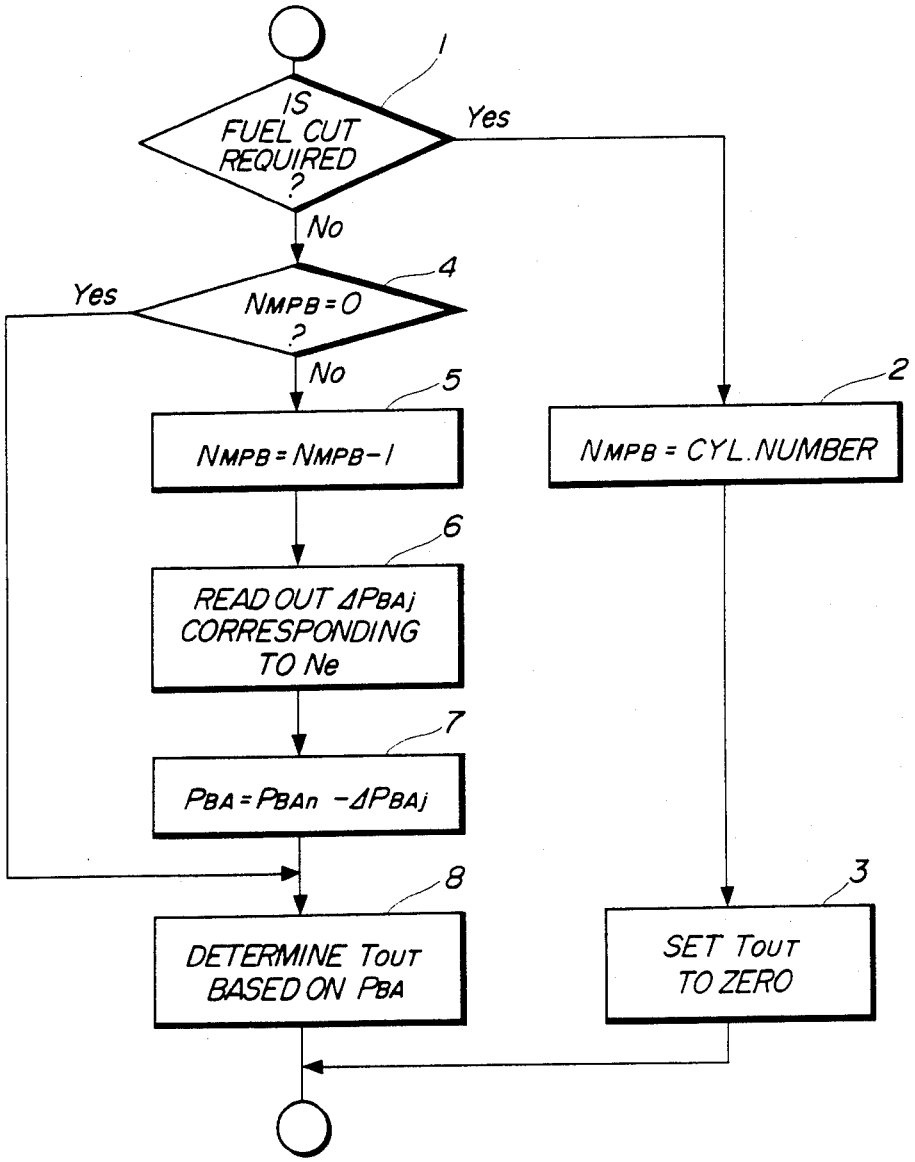
FIG. 3 is a flow chart of a manner of nominally changing a value of intake pipe pressure immediately after termination of a fuel cut operation of the engine.

FIG. 3 is a flow chart of a manner of correcting the value of an intake pipe absolute pressure PBAn signal generated immediately after termination of a fuel cut operation, according to the invention, which is executed by the CPU 503 in FIG. 2.

Figure 4:
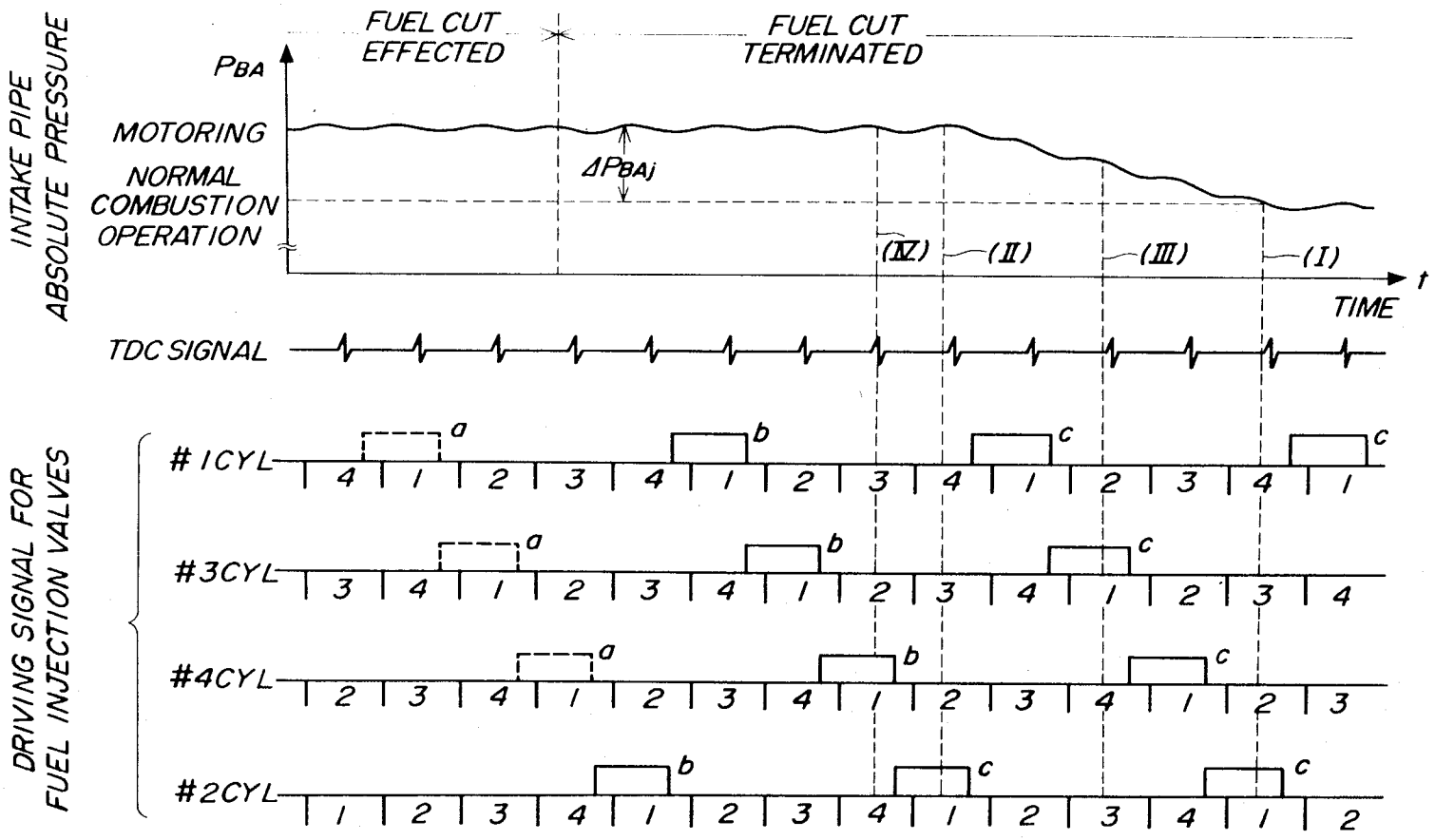
FIG. 4 is a timing chart showing, by way of example, changes in the intake pipe absolute pressure with respect to the lapse of time, at fuel cut operation of the engine and immediately after termination of same, as well as a manner of generation of driving signals for fuel injection valves for injecting fuel into the cylinders of the engine.

First, it is determined that the engine is operating in a fuel cut effecting region, on the basis of the values of engine operation parameter signals from the aforementioned various sensors, at the step 1 in FIG. 3. If the answer is yes, the value of a control variable NMPB, referred to later, is set to a predetermined value, for instance, 4, which corresponds to the number of the engine cylinders, at the step 2, and at the same time, the fuel injection period TOUT for the fuel injection valves 6 is set to zero, at the step 3. FIG. 4 shows how driving signals for the fuel injection valves 6 are generated during a fuel cut operation and immediately after termination of the fuel cut operation, as well as how the intake pipe absolute pressure PBA varies on such occasions. In FIG. 4, the suction, compression, explosion and exhaust strokes of each cylinder are denoted by numerals 1, 2, 3 and 4, respectively. It is noted in the example of FIG. 4 that the broken lines a mean that driving signals are not supplied to the respective fuel injection valves of the cylinders during fuel cut operation.

Figure 5:
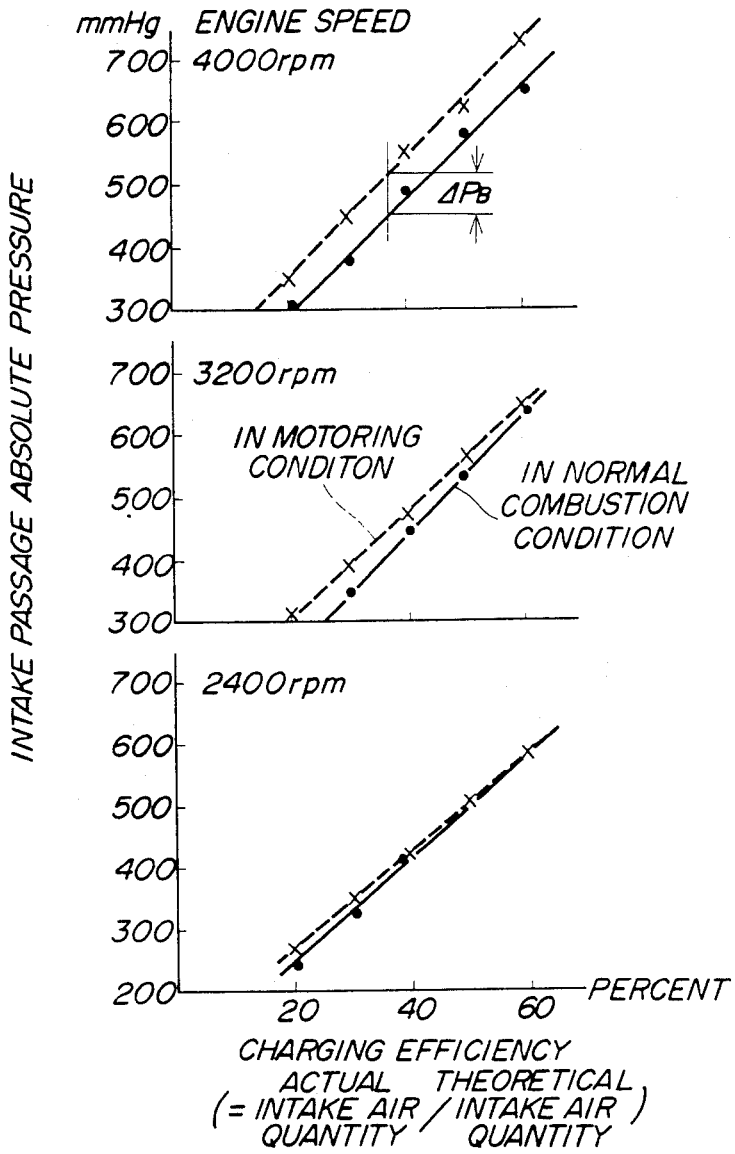
FIG. 5 is a graph showing the relationship between absolute pressure occurring in the intake pipe during motoring of the engine and during normal combustion operation of same, and the charging efficiency of the engine.

Reverting now to FIG. 3, if the answer to the question of the step 1 is negative, it is then determined whether or not the value of the control variable NMPB is zero, at the step 4. This is to determine whether or not fuel supply to cylinders of the engine has been effected a predetermined number of times corresponding to a period of time required for the influence of a difference ΔPBAj between intake pipe absolute pressure PBA at fuel cut operation or motoring and intake pipe absolute pressure PBA at normal combustion operation to diminish to an ignorable degree after termination of the fuel cut operation. In other words, this control variable NMPB is provided for the following reason: FIG. 5 shows test results showing differences in value between intake passage absolute pressure occurring at engine operation in fuel cut effecting motoring condition and that occurring at engine operation in normal combustion condition. As shown by the test results in FIG. 5, so far as the intake passage absolute pressure remains constant, the charging efficiency of the engine at normal combustion operation (shown by the solid lines in FIG. 5) is higher than that at motoring (shown by the broken lines in FIG. 5), that is, the actual intake air quantity being supplied to the engine in normal combustion operating condition is larger than that at motoring, as is already known. Conversely, the intake passage absolute pressure at motoring of the engine is higher than that at normal combustion operation, so long as the same quantity of intake air is supplied to the engine. Therefore, if during motoring of the engine the fuel supply quantity is determined on the basis of a detected value of intake pipe absolute pressure in the same manner as that employed for calculation of the fuel supply quantity during normal combustion operation of the engine, the air/fuel ratio of the mixture supplied to the engine becomes overrich during motoring, if the intake pipe absolute pressure is the same between during motoring and during normal combustion operation. To avoid this disadvantage, the quantity of fuel being supplied to the engine should be reduced after a fuel cut operation has been terminated and before the engine completely gets out of the motoring state to reach a normal combustion operation state. As a practical measure, a first batch of fuel injection quantity into each of the cylinders after the termination of a fuel cut operation should be reduced before four pulses of the TDC signal are generated after the termination of the fuel cut operation, when the absolute pressure sensor can already detect a normal value of the intake pipe absolute pressure PBA as prevailing during a normal combustion operation of the engine. To effect such reduction in the fuel supply quantity, according to the invention, the nominal value of the intake pipe absolute pressure PBA is intentionally changed so as to reduce the fuel supply quantity, as hereinafter described in detail. In order to determine the timing of nominal change of the intake pipe absolute pressure PBA, the value of the above control variable NMPB is set to 4. As the difference ΔPB between intake pipe absolute pressure at motoring and that at normal combustion operation increases along with an increase in the engine rpm, as illustrated by the test results in FIG. 5, the pressure difference ΔPB by which the intake pipe absolute pressure is to be nominally changed has also to be set so as to increase along with an increase in the engine rpm.

Referring again to FIG. 3, the predetermined number of times set at the step 3 is determined depending upon the specifications or operating characteristics of the engine, and for instance, in the present embodiment, it is set at a number equal to the number of the engine cylinders. However, if required, the same number may be set to a larger value, as below, for instance:

(i) a number of strokes executed by the engine after termination of a fuel cut operation and before the intake pipe absolute pressure drops to a value which can be assumed at normal combustion operation of the engine;

(ii) a number of strokes executed by the engine after termination of a fuel cut operation and before the intake pipe absolute pressure starts dropping from a level at motoring toward a level at normal combustion operation of the engine;

(iii) a number of strokes executed by the engine after termination of a fuel cut operation and before the intake pipe absolute pressure drops to a predetermined value falling between a level at motoring and a level at normal combustion operation, for instance, a median value between the two levels.

In the case (i), the nominal change of intake pipe absolute pressure is continuously applied until the influence of the fuel cut operation completely vanishes, and the point of terminating the nominal change is indicated by the broken line (i) in FIG. 4. According to the case (ii), the nominal change of intake pipe absolute pressure is continued until a cylinder of the engine supplied with fuel earliest of all the cylinders after termination of the fuel cut operation (#2 cylinder in FIG. 4) starts to cause a change in the intake pipe absolute pressure, and the point of terminating the nominal change is indiciated by the broken line (ii) in FIG. 4. In the case (iii), the absolute pressure nominal change is interrupted during the course of a transition of the operating condition of the engine from motoring toward normal combustion operation, and its nominal change terminating point is indicated by the broken line (iii) in FIG. 4. According to the case (iii), the influence of the nominal change of the intake pipe absolute pressure can be minimized as compared with the other cases (i) and (ii), because a change in the intake pipe absolute pressure which is applied to the fuel supply control is the smallest according to the case (iii), that is caused by subtracting the predetermined difference ΔPBAj from the actual intake pipe absolute pressure. On the other hand, according to the present embodiment, as previously stated, the number of times NMPB is set to a number equal to the number of engine cylinders. This is because after having been supplied with fuel during first consecutive exhaust and suction strokes, the earliest fuel-supplied cylinder (#2 cylinder in FIG. 4) can produce an exhaust pressure which can actually affect or change the intake pipe absolute pressure at its second suction stroke, when all the four cylinders have already been supplied with first batches of fuel, and therefore, the nominal change of intake pipe absolute pressure is terminated on this occasion, that is, immediately before the exhaust pressure of the earliest-fuel supplied cylinder can actually change the intake pipe absolute pressure, that is, the point indicated by the broken line (iv) in FIG. 4. Although in the example of FIG. 4 it is noted that the intake pipe absolute pressure drops from a level at motoring to a level at normal combustion operation during the third suction stroke of the #2 cylinder earliest supplied with fuel, this dropping timing varies depending upon the structure of the intake and exhaust systems of an engine to be applied. Further, in a method in which the fuel supply to each cylinder of the engine is not effected in synchronism with generation of each pulse of the TDC signal but the fuel supply to a plurality of cylinders is effected at one time, for instance, the predetermined number NMPB may be set at a number equal to a quotient obtained by dividing the number of all the cylinders by the number of these simultaneously fuel-supplied cylinders.

Figure 6:
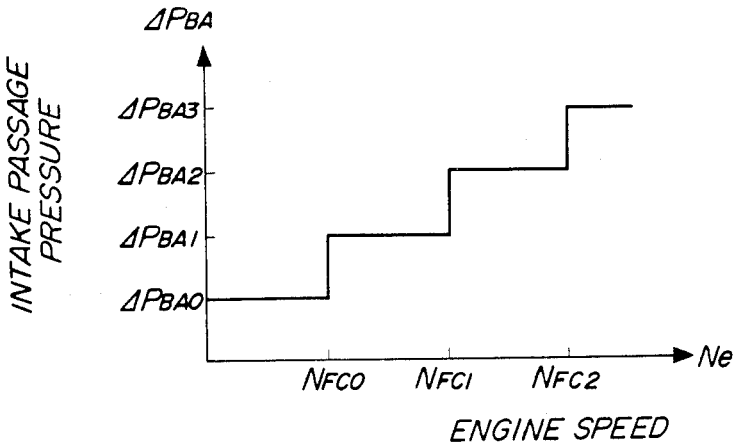
FIG. 6 is a view showing a table of the relationship between predetermined values PBA by which is nominally changed the intake pipe absolute pressure, and engine rpm Ne.

Referring again to FIG. 3, if the answer to the question of the step 4 is negative, the program proceeds to the step 5, wherein the value of the control variable NMPB is reduced by 1, and the new value is stored. Then, a value of the amount ΔPBAj for nominally changing the intake pipe absolute pressure PBA is determined, as a function of engine rpm Ne, at the step 6. FIG. 6 shows a map of values of such nominal changing amount ΔPBAj set in relation to engine rpm Ne. According to this map, the mapping is based upon the test results shown in FIG. 5 such that larger values of the nominally changing amount ΔPBAj are read out as the engine rpm Ne increases. However, the mapping is not limited to that of the map in FIG. 6, but the functional relationship between the nominal changing amount ΔPBAj and the engine rpm Ne may be designed in another manner depending upon the specifications or operating characteristics of an engine to which the method of the invention is applied.

In the step 7 in FIG. 3, a value of intake pipe absolute pressure PBAn detected at a present pulse of the TDC signal is reduced by a value of the nominally changing amount ΔPBAj determined at the step 6, and a value of the fuel injection period TOUT is calculated on the basis of the new intake pipe absolute pressure value PBA (=PBAn−ΔPBAj), by the use of the aforementioned equation (1), at the step 8. The steps 5 through 7 are repeatedly carried out until it is determined at the step 4 that the value of the control variable NMPB is equal to zero, that is, until a first batch of fuel is injected into each of the cylinders as shown in the example of FIG. 4 (indicated by the driving signals b in FIG. 4). When the determination at the step 4 provides an affirmative answer, no further nominal change is longer applied to a value PBAn of the intake pipe absolute pressure detected by the absolute pressure sensor 8, but the detected value PBAn is directly applied to calculation of the fuel injection period TOUT by the use of the equation (1) to provide driving signals c as indicated in FIG. 4, for the fuel injection valves 6.

Although the foregoing embodiment is applied to an internal combustion engine which is not equipped with a sub combustion chamber, the method of the invention may of course be applied to internal combustion engines equipped with sub combustion chambers. Further, the method of the invention may be applied not only to a fuel supply control system as illustrated and described above, but also to any other kinds of engine control systems, such as ignition timing control systems, exhaust gas recirculation control systems, and idling rpm control systems, so far as they employ a signal indicative of intake pipe (absolute) pressure as an engine operation parameter signal for setting the amount of control of the operation of the engine.

What is claimed is:

1. A method for controlling a control system for an internal combustion engine having an intake passage and pressure sensor means for detecting pressure in said intake passage, in response to at least one control parameter including values of said intake passage pressure detected by said pressure sensor means, immediately after termination of interruption of fuel supply to said engine, the method comprising the steps of:

(1) detecting whether or not there occurs a transition in the operating condition of said engine from an operating condition requiring interruption of fuel supply to said engine to an operating condition requiring fuel supply to said engine;

(2) changing a value of said intake passage pressure detected by said pressure sensor means, by a predetermined amount corresponding to a difference between a value of intake passage pressure occurring at non-combustion operation of said engine and a value of intake passage pressure occurring at normal combustion operation of said engine, so long as the rotational speed of said engine is substantially the same between said two operations of said engine, from a time immediately after said transition has been detected to a time said engine finishes a predetermined number of strokes; and (3) applying a value of said intake passage pressure thus changed, for controlling said control system.

2. A method for controlling a control system for an internal combustion engine having an intake passage and absolute pressure sensor means for detecting absolute pressure in said intake passage, in response to at least one control parameter including values of said intake passage absolute pressure detected by said absolute pressure sensor means, immediately after termination of interruption of fuel supply to said engine, the method comprising the steps of:

(1) detecting whether or not there occurs a transition in the operating condition of said engine from an operating condition requiring interruption of fuel supply to said engine to an operating condition requiring fuel supply to said engine;

(2) reducing a value of said intake passage absolute pressure detected by said absolute pressure sensor means, by a predetermined amount corresponding to a difference between a value of intake passage absolute pressure occurring at non-combustion operation of said engine and a value of intake passage absolute pressure occurring at normal combustion operation of said engine, so long as the rotational speed of said engine is substantially the same between said two operations of said engine, from a time immediately after said transition has been detected to a time said engine finishes a predetermined number of strokes; and (3) applying a value of said intake passage absolute pressure thus reduced, for controlling said control system.

3. A method as claimed in claim 2, wherein said predetermined number of strokes is set to a number of strokes of said engine required for said intake passage absolute pressure to drop from a level at said transition to a level at normal combustion operation of said engine, after said transition.

4. A method as claimed in claim 2, wherein said predetermined number of strokes is set to a number of strokes of said engine required for said intake passage absolute pressure to start dropping from a level at said transition to a level at normal combustion operation of said engine, after said transition.

5. A method as claimed in claim 2, wherein said predetermined amount is set to larger values as the rotational speed of said engine increases.

6. A method as claimed in any of claims 1, 2 or 5, wherein said control system comprises a fuel injection system for controlling the quantity of fuel being supplied to said engine, at least in response to said intake passage absolute pressure.

7. A method as claimed in claim 6, wherein said engine has a plurality of cylinders, said fuel injection system being adapted to inject fuel into said cylinders successively in synchronism with generation of pulses of a signal indicative of a predetermined crank angle of said engine, said predetermined number of strokes being set to at least a number of strokes corresponding to a period of time required for said fuel injection system to effect a number of injections equal to the number of said cylinders of said engine after said transition.

8. A method for controlling a control system for an internal combustion engine having a plurality of cylinders, an intake passage and absolute pressure sensor means for detecting absolute pressure in said intake passage, in response to at least one control parameter including values of said intake passage absolute pressure detected by said absolute pressure sensor means, immediately after termination of interruption of fuel supply to said engine, the method comprising the steps of:

(1) detecting whether or not there occurs a transition in the operating condition of said engine from an operating condition requiring interruption of fuel supply to said engine to an operating condition requiring fuel supply to said engine;

(2) reducing a value of said intake passage absolute pressure detected by said absolute pressure sensor means, by a predetermined amount corresponding to a difference between a value of intake passage absolute pressure occurring at noncombustion operation of said engine and a value of intake passage absolute pressure occurring at normal combustion operation of said engine so long as the rotational speed of said engine is substantially the same between said two operations of the engine, from a time immediately after said transition has been detected to a time all said cylinders of said engine have been supplied with fuel after said transition; and (3) applying a value of said intake passage absolute pressure thus reduced, for controlling said control system.

9. A method as claimed in claim 8, wherein said predetermined amount is set to larger values as the rotational speed of said engine increases.

10. A method as claimed in any of claims 8 or 9, wherein said control system comprises a fuel injection system for controlling the quantity of fuel being supplied to said engine, at least in response to said intake passage absolute pressure.

11. A method as claimed in claim 10, wherein said engine has a plurality of cylinders, said fuel injection system being adapted to inject fuel into said cylinders successively in synchronism with generation of pulses of a signal indicative of a predetermined crank angle of said engine, said predetermined number of strokes being set to at least a number of strokes corresponding to a period of time required for said fuel injection system to effect a number of injections equal to the number of said cylinders of said engine after said transition.

* * * * *